US009078056B2

(12) United States Patent
Yu

(10) Patent No.: US 9,078,056 B2
(45) Date of Patent: Jul. 7, 2015

(54) AUDIO RESONANCE DEVICE

(71) Applicant: Abatech Electronics Co., Ltd., Taipei (TW)

(72) Inventor: Hsiang-Chih Yu, Taipei (TW)

(73) Assignee: Abatech Electronics Co., Ltd., Taipei (TW)

( * ) Notice: Subject to any disclaimer, the term of this patent is extended or adjusted under 35 U.S.C. 154(b) by 0 days.

(21) Appl. No.: 14/080,817

(22) Filed: Nov. 15, 2013

(65) Prior Publication Data

US 2015/0139465 A1 May 21, 2015

(51) Int. Cl.
*H04R 1/02* (2006.01)
*H04R 1/00* (2006.01)

(52) U.S. Cl.
CPC . *H04R 1/00* (2013.01); *H04R 1/025* (2013.01)

(58) Field of Classification Search
USPC ..... 381/190, 191
See application file for complete search history.

(56) References Cited

U.S. PATENT DOCUMENTS

| | | | | |
|---|---|---|---|---|
| 5,675,556 | A * | 10/1997 | Erath et al. | 367/166 |
| 8,199,959 | B2 * | 6/2012 | Miyata | 381/388 |
| 8,773,373 | B2 * | 7/2014 | Sato et al. | 345/173 |
| 2005/0023937 | A1 * | 2/2005 | Sashida et al. | 310/348 |

* cited by examiner

*Primary Examiner* — Davetta W Goins
*Assistant Examiner* — Amir Etesam
(74) *Attorney, Agent, or Firm* — Leong C. Lei

(57) ABSTRACT

The audio resonance device contains a base member having a box shape with an open top side, a resonance element inside the base member having stacked ceramic layers, and at least two contact pieces on a top side, a cover member sealing the open top of the base member, and a number of elastic elements, each contacting a contact piece of the resonance element, and having an end extending through the cover member and contacting a portable appliance for picking up audio vibration from the portable appliance and delivering the audio vibration to the resonance element. The resonance element resonates with the audio vibration, and the base member provides a resonant chamber so that the audio quality from the portable appliance is enhanced. The portable appliance is not required of any modification such as opening holes.

3 Claims, 5 Drawing Sheets

AUDIO RESONANCE DEVICE

TECHNICAL FIELD OF THE INVENTION

The present invention is generally related to portable appliance, and more particular to au audio resonance device externally applied to a portable appliance for enhancing the audio quality from the portable appliance.

DESCRIPTION OF THE PRIOR ART

Portable appliances such as iPads, iPhones, and similar smart phones are widely popular these days due to their convenience and high intelligence. For these portable appliances to deliver audio signal, speakers are still the mainstream means. However, for a speaker to be small enough to fit in these portable appliances and to deliver audible sound, usually holes are configured on the portable appliances. The portable appliances therefore cannot achieve waterproof requirement. On the other hand, the scaled-down speaker usually cannot deliver high quality audio signal. Even through there are thinned speakers aimed to resolve the foregoing issues, the manufacturing process is complicated.

SUMMARY OF THE INVENTION

Therefore, an audio resonance device is provided herein for conveniently applied to a portable appliance so as to enhance its audio quality without modifying the portable appliance.

The audio resonance device contains a base member having a box shape with an open top side, a resonance element inside the base member having stacked ceramic layers, and at least two contact pieces on a top side, a cover member sealing the open top of the base member, and a number of elastic elements, each contacting a contact piece of the resonance element, and having an end extending through the cover member and contacting a portable appliance for picking up audio vibration from the portable appliance and delivering the audio vibration to the resonance element. The resonance element resonates with the audio vibration, and the base member provides a resonant chamber so that the audio quality from the portable appliance is enhanced. The portable appliance is not required of any modification such as opening holes.

Preferably, the cover member has a number of openings, each corresponding to a contact piece of the resonance element; and each elastic element is extended through an opening and exposed outside the base member.

Preferably, each elastic element contains a bended contact section and an extension section extended from the contact section.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
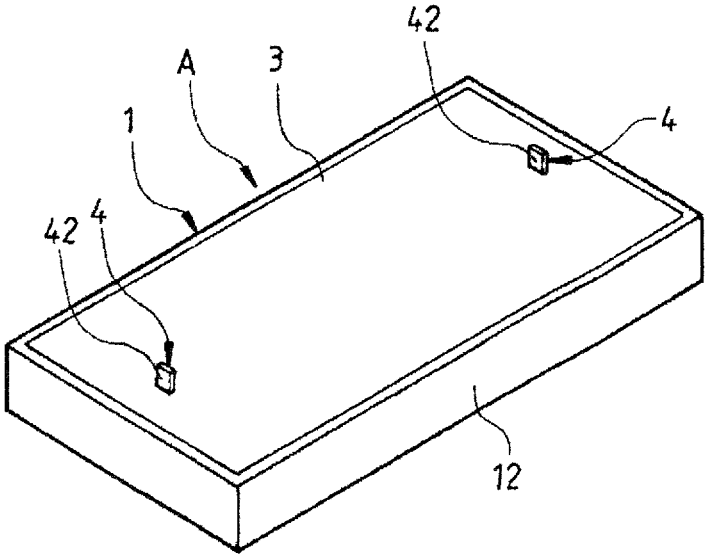
FIG. 1 is a perspective diagram showing an audio resonance device according to an embodiment of the present invention.
Figure 2:
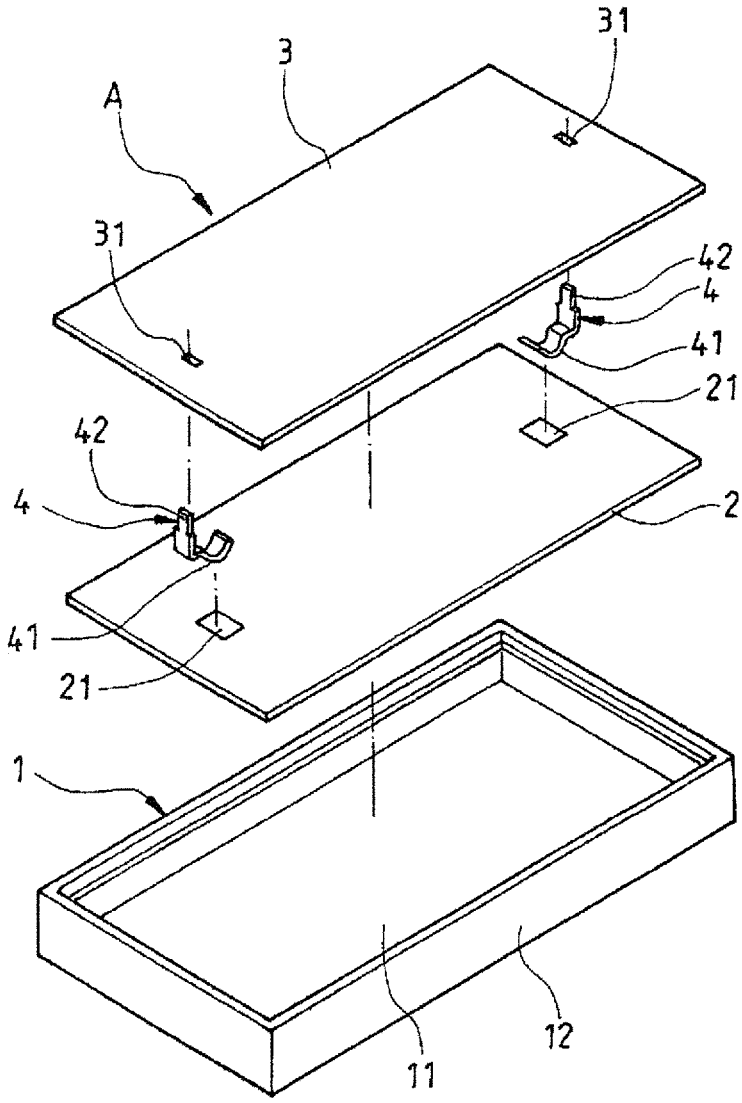
FIG. 2 is a perspective breakdown diagram showing the various components of the audio resonance device of FIG. 1.

As illustrated in FIGS. 1 and 2, an audio resonance device A according to an embodiment of the present invention mainly contains a base member 1, a resonance element 2, a cover member 3, and a number of elastic elements 4. The base member 1 has a box shape with an open top side. The base member 1 contains a bottom side 11 and a circumferential wall 12 surrounding the bottom side 11. The resonance element 2 contains a number of stacked ceramic layers, and has at least two contact pieces 21 on a top side. The cover member 3 has at least two openings 31, each corresponding locationwise to a contact piece 21. Each elastic element 4 contains a bended contact section 41 and an extension section 42 extended from the contact section 41.

The resonance element 2 is positioned inside the base member 1, and the cover member 3 seals the open top side of the base member 1. Each elastic element 4 has its contact section 41 contacting a contact piece 21 of the resonance element 2, and has its extension section 42 extended through an opening 31 of the cover member 3 and exposed outside the base member 1. Then, by attaching the audio resonance device A to a thin portable appliance such as iPad, iPhone, the contact sections 41 pick up the audio vibration of the thin portable appliance and delivers the audio vibration to the resonance element 2. The resonance element 2 resonates with the audio vibration, and the base member 1 provides a resonant chamber so that the audio quality from the thin portable appliance is enhanced. The thin portable appliance is not required of any modification such as opening holes.

Figure 3:
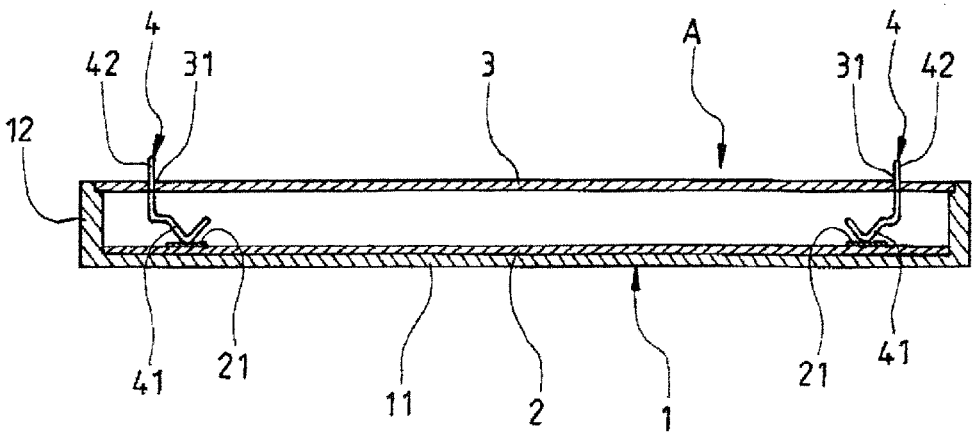
FIG. 3 is a sectional diagram showing the audio resonance device of FIG. 1.

As illustrated in FIG. 3 and as mentioned above, each elastic element 4 has its contact section 41 contacting a contact piece 21, and has its extension section 42 extended and exposed through an opening 31 of the cover member 3. The elasticity of each elastic element 4 is resulted from its bended contact section 41 and, as the cover member 3 seals the base member 1, each elastic element 4 is forced downward and its contact section 41 is tightly against a contact piece 21 so that the audio vibration is always received appropriately by the resonance element 2.

Figure 4:
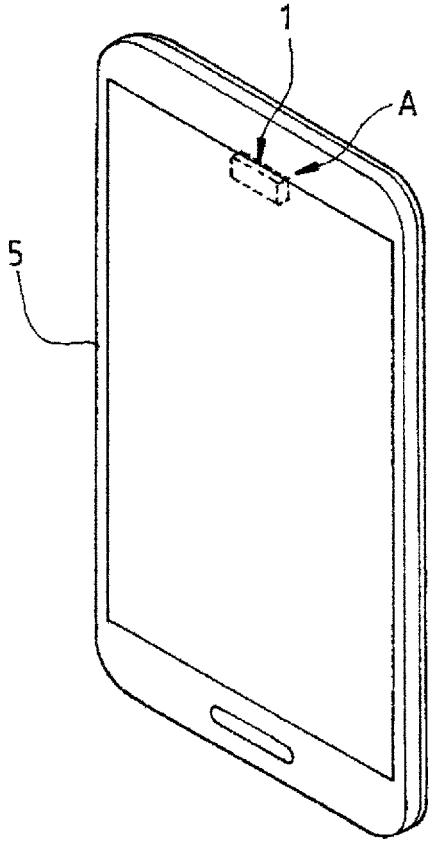
FIG. 4 depicts a scenario of the present embodiment applied to a thin portable appliance.

FIG. 4 depicts a scenario of the present embodiment applied to a thin portable appliance. As illustrated, the audio resonance device A is conveniently attached to a smart phone 5 by, for example, adhesion and no modification such as opening holes is required on the smart phone 5.

Figure 5:
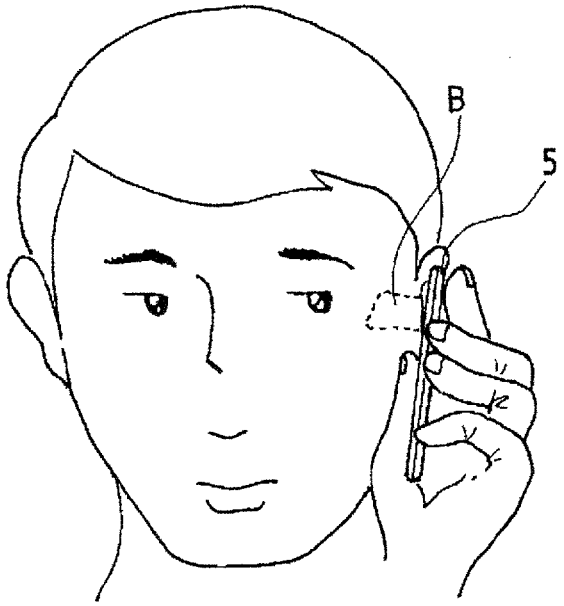
FIG. 5 depicts a scenario of a user using a thin portable appliance with the present embodiment installed.

FIG. 5 depicts a scenario of a user using a thin portable appliance with the present embodiment installed. As illustrated, the audio resonance device A is attached to and resonates with the smart phone 5. Then, as the user holds the smart phone 5 close to his ear, his ear canal B further provides a resonant chamber and the audio quality would be further enhanced. Unlike conventional devices, the smart phone 5 with the present embodiment installed is not required to be aimed at the user's ear appropriately. With the present embodiment, the user can clearly hear the audio signal from the smart phone 5 as long as the smart phone 5 is held in the vicinity of his ear.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An audio resonance device adapted to contact an external portable appliance to receive audio vibration therefrom, comprising:

a base member having a box shape with an open top side, a bottom side, and a circumferential wall surrounding the bottom side;

a resonance element inside the base member comprising a plurality of stacked ceramic layers, and at least two contact pieces formed on a top of the resonance element;

a cover member sealing the open top of the base member so as to define therebetween a resonant chamber in which the resonance element is received; and a plurality of elastic elements, each contacting a contact piece of the resonance element and having an end extending through the cover member and partly projecting outside the cover member for contacting the portable appliance for picking up the audio vibration from the external portable appliance and delivering the audio vibration to the resonance element that receives the audio vibration through the contact between the contact pieces thereof with the elastic elements and resonates with the audio vibration in the resonant chamber to provide enhanced audio quality.

2. The audio resonance device according to claim 1, wherein the cover member has a plurality of openings, each corresponding to a contact piece of the resonance element; and each elastic element is extended through an opening and exposed outside the base member.

3. The audio resonance device according to claim 1, wherein each elastic element comprises a bended contact section and an extension section extended from the contact section.

* * * * *